United States Patent [19]

Richards et al.

[11] 3,952,478

[45] Apr. 27, 1976

[54] VACUUM SHEET APPLICATOR

[75] Inventors: Louis R. Richards, Mokena; Kenneth F. Sandberg, Lockport, both of Ill.

[73] Assignee: Formax, Inc., Mokena, Ill.

[22] Filed: Oct. 10, 1974

[21] Appl. No.: 513,737

[52] U.S. Cl. ..... 53/122; 53/157; 53/389; 271/14; 271/267

[51] Int. Cl.[2] ..... B65B 25/08; B65B 41/06

[58] Field of Search ..... 53/122, 157, 389; 17/32; 271/8 B, 14, 99, 104, 107, 267, 268; 214/6 D, 6 M; 426/414, 420

[56] References Cited

UNITED STATES PATENTS

| | | | |
|---|---|---|---|
| 2,598,150 | 5/1952 | Wethe et al. | 271/14 |
| 3,053,529 | 9/1962 | Dunn | 271/107 X |
| 3,287,011 | 11/1966 | Currie | 271/107 X |
| 3,388,529 | 6/1968 | Holly | 53/122 X |
| 3,526,924 | 9/1970 | Holly | 17/32 |
| 3,675,387 | 7/1972 | Lekan | 53/122 X |
| 3,797,822 | 3/1974 | Anderson | 271/107 X |

*Primary Examiner*—Robert L. Spruill
*Attorney, Agent, or Firm*—Kinzer, Plyer, Dorn & McEachran

[57] ABSTRACT

A sheet applicator for applying individual thin, flexible sheets of paper or similar material to a series of relatively thick, flat articles (e.g., hamburger patties) as those articles fall along a defined discharge path terminating at a stacking position, comprising a shuttle with vacuum grippers for transferring each flexible sheet from a transfer position to an application position on the article discharge path, where one of the articles engages the sheet and carries it to the end of the discharge path. The grippers engage at least three peripheral points around the edges of the sheet; the falling article pulls the sheet from the gripper, falling through a central opening in the shuttle. The carriage then returns for the next sheet. A single-sheet feeder applies the sheets to the shuttle in registry with the vacuum grippers.

30 Claims, 9 Drawing Figures

VACUUM SHEET APPLICATOR

BACKGROUND OF THE INVENTION

In many manufacturing applications, particularly in food processing, it is highly desirable to interleave the finished articles with thin, flexible sheets of waxed paper, cellophane, plastic film, or other very thin, flexible material. For example, in packaging meat slices or hamburger patties, individual sheets of waxed paper or like material inserted between adjacent pieces of meat prevent the meat from sticking together and preserve the integrity of the individual meat pieces. The same situtation is presented with stacks of sliced cheese; the cheese slices tend to "grow" back together unless the slices are separated by sheets of thin, flexible material.

Often, in the basic processing equipment, there is some stage of operation at which the individual hamburger patties or other such articles traverse a given discharge path, usually terminating at a stacking position; the preferred technique is to suspend individual sheets of waxed paper or the like at some intermediate position on the path so that each article, moving along the path, picks up a sheet of paper and comes to rest in a stack in which the articles are interleaved one-for-one with the paper sheets.

One known interleaving device, comprising an accessory to a hamburger patty machine, is described in Richards et al U.S. Pat. No. 3,126,683, issued Mar. 31, 1964. In the Richards device, the hamburger patties fall freely through space along a predetermined path terminating at a stacking destination. In that device, a sheet of paper is supported at its opposite edges on a frame positioned so that the paper sheet extends across the path of movement of the hamburger patties. A falling hamburger patty engages the sheet of paper and carries the paper with it, through the frame and onto the stack. This device works efficiently in some applications, but does require the use of paper that is wide enough and stiff enough to be self-supporting on frame members that are spaced by a distance greater than the maximum dimension of the hamburger patties. Consequently, the paper must be considerably wider than the patties with which it is interleaved, particularly if thin paper is employed. The apparatus has some tendency toward malfunction, even when relatively wide sheets of paper are used, in that they may occasionally fall from the frame before being engaged by a hamburger patty, resulting in a failure to achieve effective interleaving.

Another prior art interleaving apparatus is set forth in Bush U.S. Pat. No. 2,877,120, issued Mar. 10, 1959, in which individual sheets of paper are cut from a continuous web by a knife mechanism. The paper is held at the cutting position, projecting outwardly from the knife as a cantilever member, and is supported by jet air stream that impinges upon the bottom of the paper. A slice of meat or similar article engages the cantilever-supported paper and carries the paper with it to a stacking location. The jet stream, however, is somewhat difficult to adjust to maintain the paper in the proper position. Moreover, the mechanism is best employed with an apparatus in which the movement of the meat slices or other articles is more closely controlled than in many hamburger patty machines and the like, where there may be some variation in the movement of the objects along the discharge path.

In most interleaving devices using stacks of pre-cut sheets of thin waxed paper or like material, the individual sheets are initially pulled from the stack in a direction including a substantial vector component parallel to the plane of the paper. This produces a tendency toward double-sheeting, particularly if the coefficient of friction between sheets varies, as is often the case. Double-sheeting is highly undesirable; in some applications, it is completely unacceptable. The problem may be alleviated somewhat by using a tear pin with specially punched sheets, but this expedient introduces an almost equally objectionable problem of chaff, from the punched paper, engaging and adhering to the food product. A similar difficulty is experienced with interleavers that stack up two or more sheets at the interleaving position whenever the hamburger patty machine or other food processing equipment with which the interleaver is utilized malfunctions and fails to pass patties through the interleaving position for one or more cycles of operation.

Many of these problems are effectively controlled or minimized by the sheet applying device described in Lekan U.S. Pat. No. 3,675,387, issued July 11, 1972. In that apparatus, an open carriage equipped with two vacuum grippers pulls sheets from a supply hopper and transfers them into the discharge path of the hamburger patties or like articles. As each sheet is pulled onto the carriage it is bent so that cantilever suspension of the sheet becomes possible. This device permits use of smaller sheets than the Richards et al interleaver and is somewhat more consistant in positioning the sheets than the Bush air-jet lift. However, the use of a cantilever suspension is a limiting factor; even with consistent bending of the sheets, erratic operation may occur when extremely flexible sheets are used.

SUMMARY OF THE INVENTION

It is a principal object of the present invention, therefore, to provide a new and improved sheet interleaver device for interleaving individual thin, flexible sheets of paper, cellophane, plastic film, of like material with a series of relatively thick, flat articles such as hamburger patties, as the articles traverse a given discharge path, that is highly reliable in operation and adaptable to use with a wide variety of different forms of processing equipment.

A particular object of the invention is to provide a new and improved sheet applicator device for engaging hamburger patties or similar articles with thin, flexible sheets of paper or plastic film that supports each sheet at at least three points around its edges and that grips the sheet securely until the very moment of its engagement by a falling article.

A further object of the invention is to provide a new and improved sheet applicator that allows the use of sheets only minimally larger than the articles to which the sheets are applied.

An additional object of the invention is to provide a new and improved sheet applicator, suitable for use with high speed food processing machinery, that inherently and consistently feeds single sheets with no appreciable tendency toward double sheeting.

Another object of the invention is to provide a new and improved sheet applicator, adapted to use with hamburger patty forming machines and other like food-processing machines, that cannot stack multiple sheets in the interleaving position in the event of a malfunction of the food-processing machine.

A specific object of the invention is to provide a new and improved sheet applicator, having the aforementioned operating characteristics, that is simple and inexpensive in construction, reliable in operation, and require a minimum of maintenance.

Accordingly, the invention pertains to a sheet applicator for interleaving individual, thin, flexible sheets of paper, cellophane, plastic film or like material with a series of hamburger patties or like flat, relatively thick articles as the articles traverse a given discharge path in sequential spaced relation to each other, the path terminating at a stacking position. The sheet applicator comprises a vacuum transfer shuttle which is reciprocally movable along a shuttle path between a sheet application position intersecting the article discharge path and sheet transfer position adjacent to, but spaced from the discharge path. The shuttle has a central opening which encompasses the article discharge path, through which one of the articles may passs freely, when the shuttle is in its application position. The shuttle also has at least three small vacuum grippers which are distributed around the peripheral edges of the central opening in the shuttle, just beyond the edges of an article passing therethrough. The sheet applicator also has a sheet feeder which includes a releasable sheet holder means for depositing a single, thin, flexible sheet on the shuttle in registry with the shuttle vacuum grippers, whenever the shuttle reaches its sheet transfer position. Each thin, flexible sheet is of a size and configuration so as to cover all of the shuttle vacuum grippers. Also included are actuating means for actuating the shuttle and the sheet feeder in synchronism with movement of the articles along the discharge path and in synchronism with each other, so that the sheet holder means of the sheet feeder releases each sheet as it arrives at the transfer position in registry with the shuttle vacuum grippers, and so that the shuttle is in its sheet application position each time an article moves therethrough.

DESCRIPTION OF THE PREFERRED EMBODIMENT

Figures 1, 2:
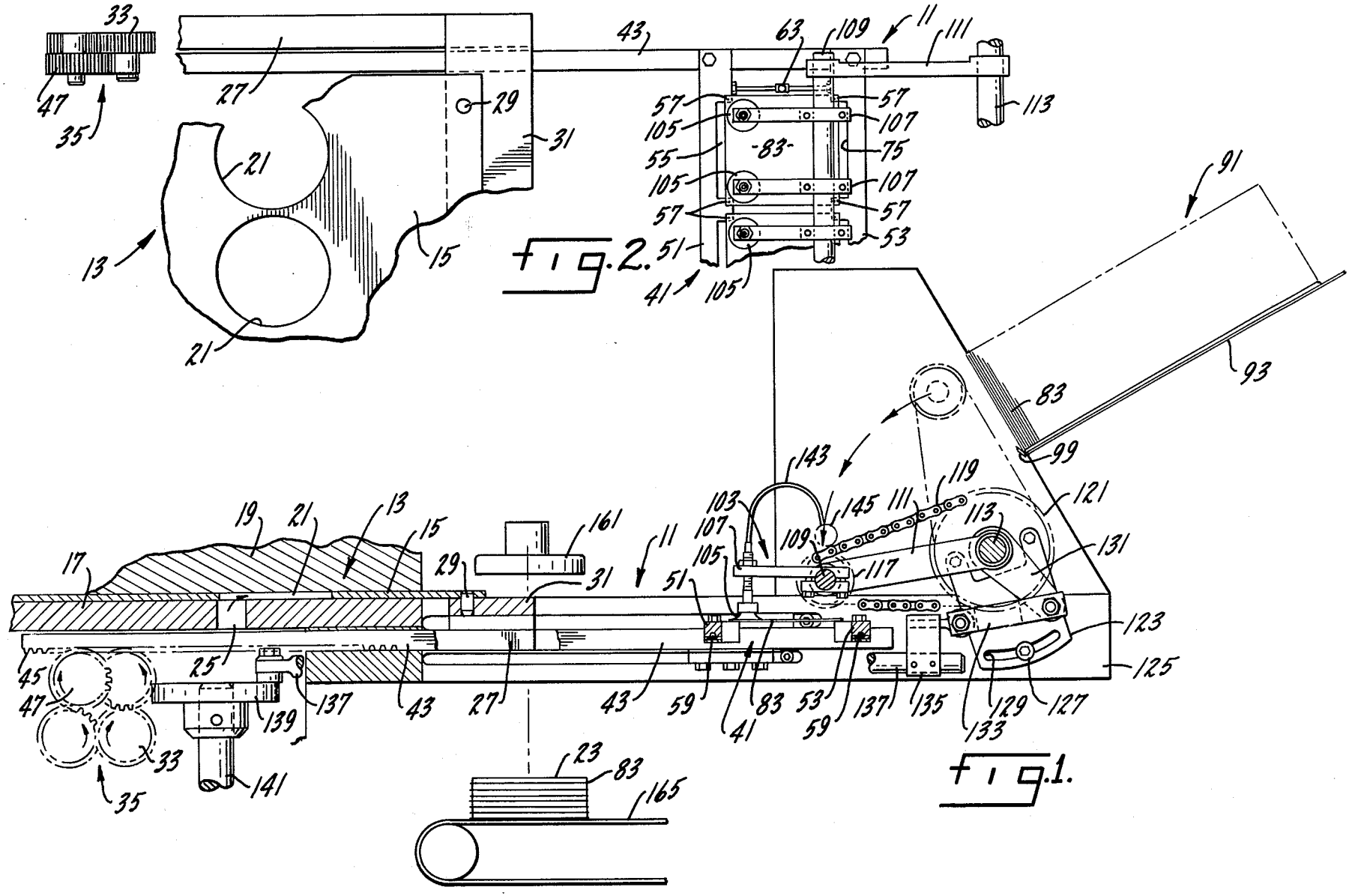
FIG. 1 is a partial side elevation view of a sheet applicator of this invention connected to a reciprocal food patty molding machine.
FIG. 2 is a partial top plan view of the sheet applicator of FIG. 1.

FIG. 1 illustrates a sheet applicator 11 constructed in accordance with the teachings of this invention and connected to the output side of a food patty molding machine 13. The food patty molding machine 13 may be any of the types conventionally used to mold and shape food patties. An example of one of these machines is a molding machine manufactured and sold by Formax, Inc. of Mokena, Illinois, known as a FORMAX 24 patty machine. The food patty molding machine includes a multiple cavity mold plate 15 which reciprocates between a top plate 17 and a mold cover 19. The mold plate may be formed with a number of patty cavities 21. The machine shown in this example has six cavities which are circular in shape to form relatively thick, flat articles 23 such as hamburger patties, cheese slices, or the like. The food to be molded enters the cavities 21 through input passages 25 located in the top plate 17.

The mold plate 15 is moved in a reciprocal path by mold plate drive bars 27, located on opposite sides of the machine. The bars 27 are driven in a reciprocal motion by a mechanism which is not shown. Pins 29 located opposite sides of the machine connect the mold plate to a cross member 31 which in turn is fastened to the mold plate drive bars 27. Pinion gears 33 which are a part of gear reversal mechanisms 35 located on each side of the machine engage gear teeth (not shown) on the undersides of the drive bars 27 to transfer the reciprocal movements of the mold plate drive bars to other parts of the sheet applicator which will be described hereinafter.

The sheet applicator 11 includes a vacuum transfer shuttle 41 which is attached to shuttle drive bars 43 located on opposite sides of the food patty molding machine 13 and positioned inwardly of the mold plate drive bars 27. Gear racks 45 are formed on the undersides of the shuttle drive bars and these racks are driven by pinion gears 47 which are part of the gear reversal mechanisms 35, and are driven by the pinion gears 33.

Figure 6:
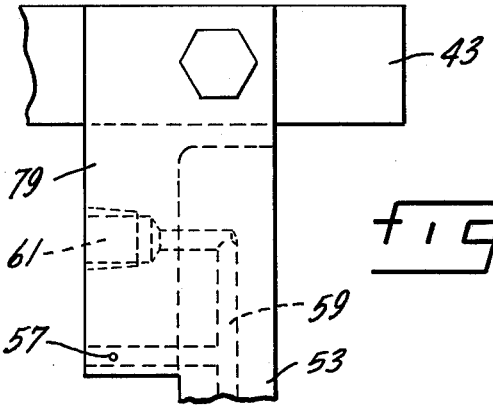
FIG. 6 is an enlarged, partial top plan view of the apparatus of FIG. 4.
Figure 9:
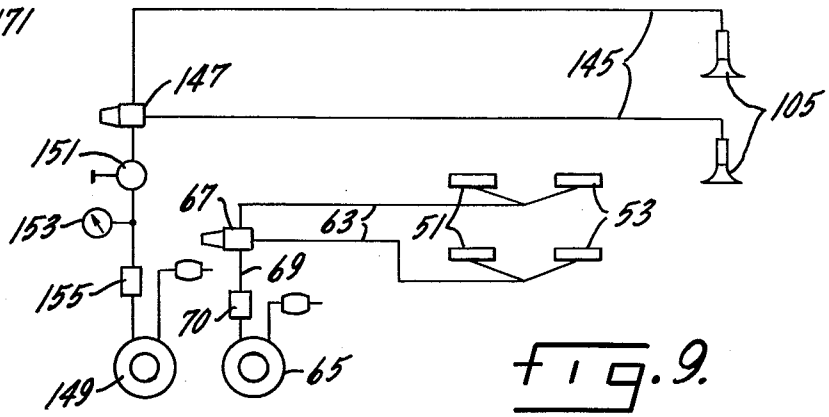
FIG. 9 is a schematic illustration of the vacuum system of the sheet applicator.

The vacuum transfer shuttle 41 includes vacuum cross bars 51 and 53 which extend between and are fastened to the shuttle drive bars 43. The shuttle drive bars and the vacuum cross bars define a central opening 55 in the shuttle. Suction grippers 57 are located on the upper surfaces of the suction bars and more or less surround the periphery of the central opening 55. The vacuum grippers 57 are outlets connected to vacuum lines 59 formed in and extending through the vacuum cross bars 51 and 53 as shown in enlarged detail in FIG. 6 of the drawing. The vacuum lines are connected at inlets 61 to vacuum supply lines 63 shown in FIG. 2. FIG. 9 shows schematically the connection of the vacuum bars 51 and 53 to a vacuum pump 65. Vacuum lines 63 leading from opposite ends of the vacuum bars 51 and 53 connect to a solenoid operated valve 67 controlling the input line 69 to the vacuum pump 65. A filter 70 may be installed between valve 67 and pump 65.

Figure 4:
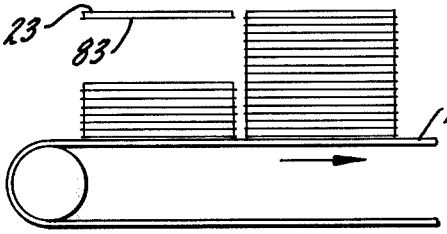
FIG. 4 is an enlarged, partial top plan view of the apparatus of FIG. 3.
Figure 4:
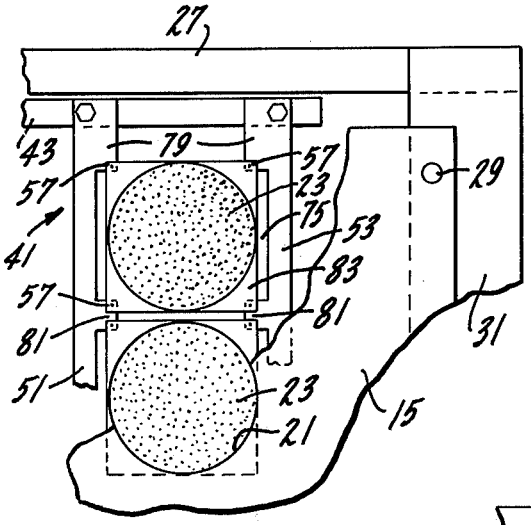

The vacuum grippers 57 on one vacuum bar are aligned with vacuum grippers on the opposite vacuum bar and the vacuum grippers are grouped in sets of four to form rectangular configurations spaced along the length of the vacuum cross bars 51 and 53. Each rectangular configuration of vacuum grippers defines a separate pathway 75 through the central opening 55 of the vacuum shuttle. The vacuum grippers are located on corners of projections formed as parts of the vacuum bars 51 and 53. At opposite ends of the vacuum bars, the projections 79 each contain a single vacuum gripper 57. The intermediate projections 81 each contain a pair of vacuum grippers positioned at corners thereof, thus enabling the pathways 75 to be closely spaced relative to one another. The spacing of the projections 79 and 81 and the location of the vacuum grippers 57 thereon are such that the vacuum grippers and projections will support the corners of thin, flexible sheets 83 placed on the vacuum shuttle while allowing passage of thick, flat articles 23 produced by the food patty molding machine 13 through the pathways 75 in the manner shown in FIG. 4 of the drawings.

Figure 3:
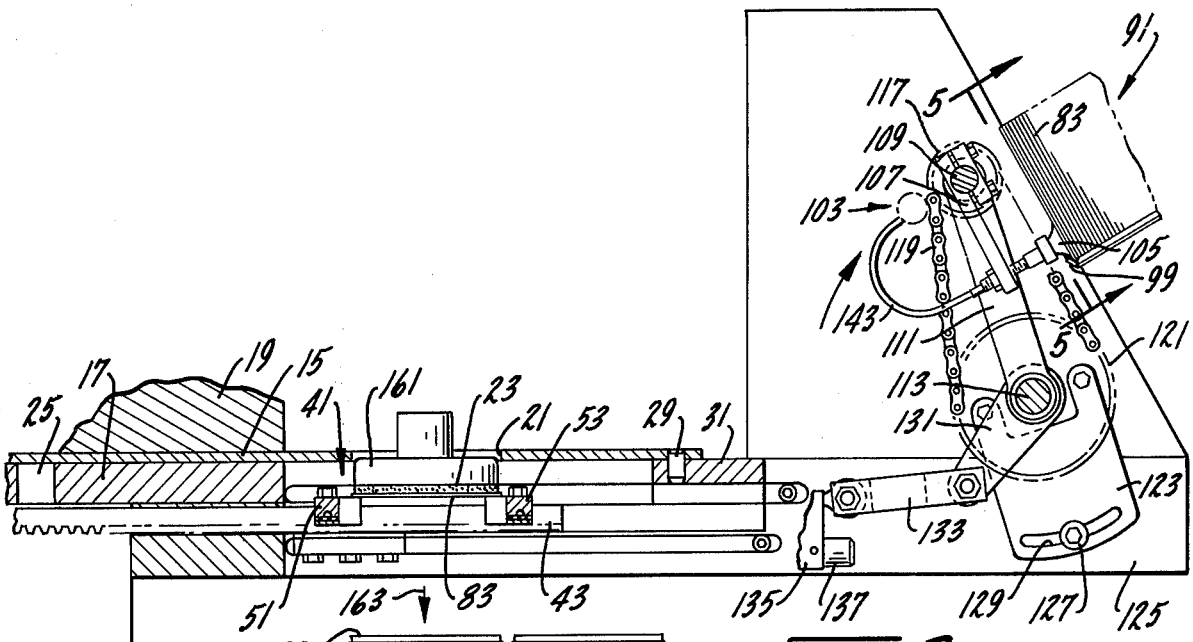
FIG. 3 is a partial side elevational view, similar to FIG. 1, showing a different stage in the sequence of operation of the sheet applicator.

A sheet feeder 91 for placing thin, flexible sheets 83 on the vacuum transfer shuttle 41 in alignment with the rectangular groupings of the vacuum grippers 57 to cover the pathways 75 is shown in FIGS. 1, 2 and 3 of the drawings. A sheet feeder of the general configuration of the type described herein is sold by Thiele Engineering Division, Cherry-Burrell Corporation of Minneapolis, Minnesota, and is described as a "Thiele Coupon Placer — Reciprocating Model". The sheet feeder is equipped with a number of inclined hoppers 93, one for each patty cavity 21 in the mold plate 15. In this example, there are six hoppers 93, corresponding to the six food patty cavities 21. A stack of thin, flexible sheets 83 are stored in each hopper with the sheets standing on edge and held in the hopper by stops 95 located at each corner of the open wall 97 positioned at the lower end of the inclined hopper. Blades 99 at the top and bottom of this open wall engage the top and bottom center of the end sheet 83.

Figure 5:
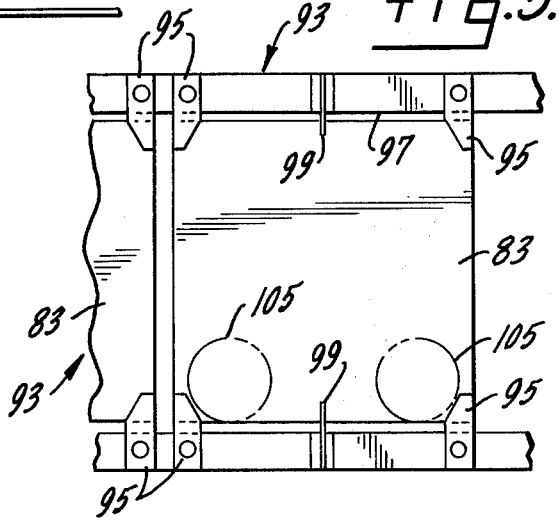
FIG. 5 is an enlarged, partial view taken along line 5—5 of FIG. 4.

The sheet feeder 91 includes a number, in this case six, of releasable sheet holders 103 which each remove a single sheet 83 from a hopper 93 and deposit the sheets on the vacuum transfer shuttle 41. The sheet holders each include a pair of suction or vacuum cups 105. The vacuum cups are formed of a soft flexible material, such as soft rubber. Each cup is mounted on the end of an arm 107. The arms are clamped at their opposite ends to a cross shaft 109. The arms are spaced in pairs along the cross shaft so that two suction cups will engage a sheet 83 at an open end 97 of a hopper 93, with the suction cups contacting the botttom edge of the sheet in the manner shown in FIG. 5 in which each cup is located immediately inwardly of the corner stops 95 and outwardly of the knives 99. The opposite ends of the cross shaft 109 are journaled in the free ends of arms 111 which are located on opposite sides of the machine. The other ends of the arms are fixed to shaft 113 which extends across the width of the sheet feeder.

At least one sprocket 117 is affixed to the cross shaft 109 near one end thereof. The sprocket engages a chaim 119 which also extends around a larger sprocket 121. The larger sprocket 121 is journaled on shaft 113 and is affixed to a plate 123. The plate 123 is adjustably connected to a base 125 for movement through a limited arc by means of a threaded fastener 127 which fits through an arcuate slot 129 in plate 123. Release of the threaded fastener 127 permits arcuate movement of the plate 123 and rotation of the sprocket 121. Rotation of sprocket 121 causes rotation of sprocket 117. This rotates the arms 107 and thereby adjusts the operating positions of the suction cups 105.

A stub arm 131 rigidly fastened to shaft 113 is pivotally connected at its free end to one end of a link 133. The opposite end of the link 133 is pivotally connected to a lug 135, which is fastened to a connecting rod 137. Connecting rod 137 is pivotally fastened to crank 139 mounted on a shaft 141. The shaft 141 is driven by a motor, which is not shown.

The suction for vacuum cups 105 is drawn through tubing 143 connected to each cup with the tubing connected to a manifold 145. As is shown schematically in FIG. 9, the manifold 145 leads to a solenoid controlled valve 147 which is connected to the input side of vacuum pump 149. As is customary, a relief valve 151, gauge 153 and filter 155 may be installed in the tubing between the solenoid controlled valve and the pump.

A row of knock-out cups 161 are mounted above the vacuum sheet applicator 11 for vertical movement with each cup aligned with a cavity 21 in the mold plate 15, when the mold plate is in its outwardly extended position as shown in FIG. 3. Upon downward movement, the cups force the thick, flat food articles 23 out of the cavities 21 of the mold plate. The vertical discharge paths taken by the patties 23 upon discharge from the mold plate 15 are designated by the arrow 163. While following these paths, the hamburger patties move through the pathways 75 formed in the central openings 55 of the vacuum shuttle 41 and land on conveyor 165 which transports the stacked patties to a discharge station.

Figure 8:
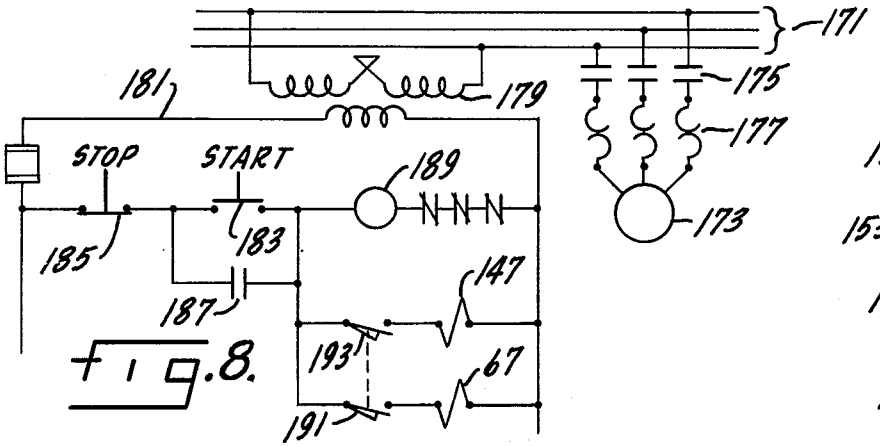
FIG. 8 is a schematic illustration of part of the electrical controls for the sheet applicator.

A simplified electrical circuit for the vacum sheet applicator 11 and portions of the food patty molding machine 13 is shown schematically in FIG. 8. A 480 volt power supply 171 feeds the main drive motor 173 for the hamburger patty machine through switches 175 and fuses 177. A stepdown transformer 179 supplies 115 volt current to circuit 181. This circuit includes start-stop buttons 183 and 185 which operate switch 187 controlling motor 189 which drives the vacuum pumps 65 and 149. Also controlled by this circuit are rotary limit switches 191 and 193 which operate solenoid controlled valves 67 and 147, respectively.

Considering the operation of the vacuum sheet applicator 11, it may first be assumed that the applicator is in the operating condition illustrated in FIG. 1 with the vacuum transfer shuttle 41 advanced to the extreme rightward limit of its travel, which will be referred to as its sheet transfer position. When the shuttle is in its sheet transfer position, the mold plate 15 is at the extreme leftward position of its travel inside the food patty molding machine 13 with the row of cavities 21 located between the top plate 17 and mold cover 19 of the molding machine. Ground meat enters the patty cavities 21 through the input passages 25 from a meat pump, which may be of conventional construction and is not shown in the drawings.

While the food patties 23 are being formed in the cavities 21, the sheet feeder 91 and particularly the vacuum cups 105 of the releasable sheet holder 103 are placing a row of thin, flexible sheets 83 on the vacuum transfer shuttle 41 with the corners of each sheet being aligned with a set of four grippers 57 defining a pathway 75 through the central opening 55 of the vacuum transfer shuttle. To insure that the corners of the sheets 83 are properly engaged by the vacuum grippers 57, the downward travel of the arms 107 is adjusted so that the vacuum cups 105 force the sheets 83 downward into the opening 55 of the shuttle a slight amount, that is, past the plane of the vacuum grippers 57. As the vacuum cups push the thin, flexible sheets 83 into position on the vacuum grippers 57, the vacuum in line 143 is released so that the vacuum cups will not pull the sheet from the vacuum gripper 57 upon return movement of the releasable sheet holder.

Figure 7:
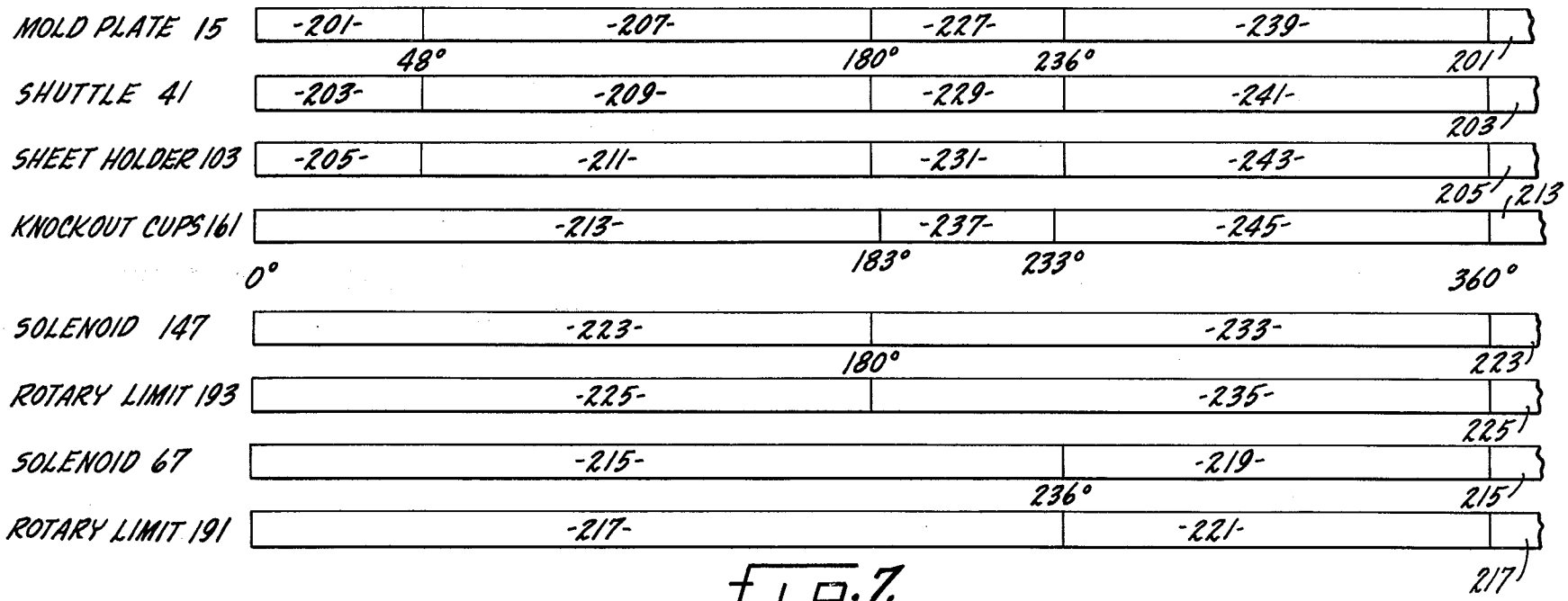
FIG. 7 is a bar graph showing a complete operating cycle of the sheet applicator.

The first stage of the operating cycle of the sheet applicator 11 and food patty molding machine 13 is shown in the bar graph of FIG. 7 of the drawings. Portion 201 of the mold plate 15 bar indicates that for the first 48° of the operating cycle, the mold plate 15 is in the positon shown in FIG. 1 of the drawings and is at rest. The mold cavities 21 are being filled during this portion of the operating cycle. In portion 203 of the shuttle 41 bar, the shuttle in the sheet transfer position shown in FIG. 1 and is at rest ready to receive the sheets 83. Portion 205 indicates the part of the cycle in which the sheet holder 103 is placing the sheets 83 on the shuttle 41 and begins its upward rotation towards the hoppers 93.

In the next portion of the operating cycle, from 48° to 180° of the operating cycle, shown in portion 207 of the bar graph for the mold plate 15, portion 209 of the bar graph for the shuttle 41, and portion 211 of the bar graph for the sheet holder 103, these parts move generally from the positions shown in FIG. 1 of the drawings generally to the positions shown in FIG. 3 of the drawings. Portion 213 of the bar graph for the knock-out cups 161 covers 0° to 183° of the operating cycle. The knock-out cups remain in the retracted or up position shown in FIG. 1 through this portion of the machine cycle, remaining up for an additional 3° after the other parts have reached the positions of FIG. 3.

The mold plate 15 and the vacuum transfer shuttle 41 are moved to the positions shown in FIG. 3 upon movement of the mold plate drive bars 27. Movement of the drive bars 27 is translated through the reversing gear mechanisms 35 to the shuttle drive bars 43. Also moving in synchronization with the mold plate drive bars 27 is the drive shaft 141 which rotates its crank 139 to move connecting rod 137, and thereby rotate cross shaft 113 of the releasable sheet holder 103. When the mold plate 15 reaches the position shown in FIG. 3, its cavities 21 are aligned with the vertical paths 163 along which the thick, flat patties 23 will fall into stacks on the conveyor 165. As shown in FIG. 3, the vacuum transfer shuttle 41 is also aligned with the vertical paths 163, thus positioning the individual pathways 75 through the opening 55 in the shuttle in alignment with their respective cavities 21 of the mold plate 15. The sheets 83 of thin, flexible material are positioned directly below the cavities 21 in the mold plate. This arrangement is more clearly shown in enlarged detail in FIG. 4 of the drawings.

During the first 180° of the machine cycle, as indicated by portions 215 and 217 of the bar graphs of FIG. 7, the rotary limit switch 191 and the solenoid valve 67 controlled thereby are actuated providing a vacuum to the vacuum bars 51 and 53 of the vacuum transfer shuttle 41. Vacuum could be maintained on the vacuum bars during the entire 360° operating cycle, since the falling patties 23 are heavy enough to remove the thin, flexible sheets 83 from the vacuum grippers 57 even while the vacuum is applied. However, the vacuum is shut off to the vacuum grippers during the part of the operating cycle indicated by portions 219 and 221 of the bar graph of FIG. 7 in order to extend the life of the vacuum pump 65.

During the movement of the releasable sheet holder 103 from the position shown in FIG. 1 to the position of FIG. 3, which occurs during the 48° to 180° part of the operation cycle, as indicated by the portions 223 and 225 of the bar graph of FIG. 7, the solenoid 147 and the rotary limit switch 193 controlling its operation are in the "off" position. Thus, during this portion of the operating cycle, there is no vacuum applied to the vacuum cups 105. Actually, solenoid 147 and switches 193 are off and there is no vacuum to the vacuum cups through the first half of the operating cycle, that is from 0° to 180°.

The arms 107 supporting the vacuum cups 105 rotate with shaft 109 through an angle of somewhat less than 180° during movement of the sheet holder 103 from the position of FIG. 1 to the position of FIG. 3. Rotation of the shaft 109 is caused by the walking of the sprocket 117 in the chain 119 which fits around the fixed sprocket 121. In this embodiment, the ratio between the diameter of the sprockets 121 and 117 is approximately 26 to 11. It should be understood that this ratio can be varied depending on the angle of tilt of the hoppers 93. During this movement, the vacuum cups 105 are rotated from a downwardly facing position to an upwardly facing position where they can engage the bottom edge of a thin, flexible sheet 83 located in the hopper 93 in the manner shown in FIG. 5 of the drawings.

In the portion of the cycle of operation of the machine from 180° to 236°, which is indicated by portions 227, 229 and 231 of the bar graph of FIG. 7, the mold plate 15 is in its extended or out position as shown in FIG. 3 and is at rest. The vacuum shuttle 41 is in the position shown in FIG. 3 and als is at rest. The sheet holder 103, due to the opening of its solenoid controlled valve 147 through the closing of its limit switch 193, as indicated by portions 233 and 235 of the bar graph of FIG. 7, has a vacuum established in its vacuum cups 105, removes single sheets of paper 83 from each of the hoppers 93 and begins its downward return movement.

During approximately the same time interval as indicated by the portion 237 of the bar graph, the knock-out cups 161 move to the lower knock-out positions shown in FIGS. 3 and return to the elevated positions of FIG. 1 thereby dislodging the patties 23 from the cavities 21 of the mold plate 15. The patties thus discharged, engage the sheets 83 held in the shuttle 41, removing these sheets from the vacuum grippers 57 and carrying the sheets with the patties along the vertical stacking paths 163 to the conveyor 165. It should be noted that the duration of the down and up movement of the knock-out cups 161 is 6° less than the at rest time of the mold plate 15 and shuttle 41 in the positions shown in FIG. 3 and as indicated by the portions 227 and 229 of the bar graph. This shorter duration of movement is to insure that the knock-out cups 161 move into and out of the cavities 21 in the mold plate 15 while the mold plate and shuttle 41 are at rest.

During the remainder of the operating cycle as indicated by the portions 239, 241 and 243 of the bar graph, the mold plate 15, the vacuum transfer shuttle 41 and the releasable sheet holder 103 are returning to their positions shown in FIG. 1. In this portion of the operating cycle, as indicated by portion 245 of the bar graph, the knock-out cups 161 remain in the up or retracted position.

Adjustment of the vacuum cups 105 of the releasable sheet holder 103 relative to the vacuum transfer shuttle 41 and the sheet hoppers 93 is accomplished by rotation of the plate 123 which is fastened to the sprocket 121. This is accomplished by releasing the threaded fastener 127 and then moving the plate along a path defined by the fastener moving in the slot 129. Movement of the plate causes rotation of the sprocket 121 which moves the chain 119, and thereby rotates sprocket 117. Shaft 109 rotates with sprocket 117. Shaft 109 rotates with sprocket 117 and moves arms 107 in an arc.

We claim:

1. A sheet applicator for applying thin, flexible sheets of paper, cellophane, plastic film or like material, individually, to a series of hamburger patties or like flat articles of given surface configuration, as the articles traverse a given discharge path in sequential spaced relation to one another, the sheet applicator comprising:

a vacuum transfer shuttle reciprocally movable along a shuttle path between a sheet application position intersecting the article discharge path and a sheet transfer position adjacent to, but spaced from the discharge path, the shuttle having a central opening which encompasses the article discharge path, through which one of the articles may pass freely, when the shuttle is in its application position, the shuttle including at least three small vacuum grippers distributed around the peripheral edges of the central opening in the shuttle, just beyond the edges of an article passing therethrough, with said vacuum grippers being distributed around at least a major portion of the peripheral edges of said central opening;

a sheet feeder, including releasable sheet holder means, for depositing a single, thin, flexible sheet on the shuttle in registry with the shuttle vacuum grippers whenever the shuttle reaches its sheet transfer position, each sheet being of a size and configuration to cover all of the shuttle vacuum grippers; and actuating means for actuating the shuttle and the sheet feeder in synchronism with the movement of the articles along the discharge path and in synchronism with each other, so that the sheet holder means of the sheet feeder releases each sheet as it arrives at the transfer position in registry with the shuttle vacuum grippers and so that the shuttle is in its sheet application position each time an article moves therethrough.

2. A sheet applicator, according to claim 1, in which each of said thin, flexible sheets is polygonal in shape and said shuttle includes a plurality of small vacuum grippers, each positioned to engage a corner of said polygonal sheet.

3. A sheet applicator, according to claim 2, in which each of said thin, flexible sheets is rectangular in shape and said shuttle includes four small vacuum grippers with each gripper positioned to engage a corner of said sheet.

4. A sheet applicator, according to claim 3, in which a surface of the shuttle adjacent each vacuum gripper provides support for a corner of said sheet.

5. A sheet applicator, according to claim 2, in which each of said flat articles is circular in shape, each of said thin, flexible sheets is polygonal in shape with its corners extending beyond the periphery of said circular article, and said shuttle includes a plurality of small vacuum grippers, each positioned to engage a corner of said sheet.

6. A sheet applicator, according to claim 5, in which each of said flat articles is circular in shape, each of said thin, flexible sheets is rectangular with its corners extending beyond the periphery of said circular article, and said shuttle includes four small vacuum grippers, with each gripper positioned to engage a corner of said sheet.

7. A sheet applicator, according to claim 1, in which said sheet feeder includes a sheet hopper, and said sheet holder means removes a single, thin, flexible sheet from the sheet hopper and deposits the sheet on the shuttle whenever the shuttle reaches its sheet transfer position.

8. A sheet applicator, according to claim 7, in which a stack of thin, flexible, rectangular sheets are stored on edge on an incline formed as part of said hopper, an outlet for said hopper is located at the lower end of said incline, and said sheets are held in said hopper by stops which engage each corner of the bottom sheet in the hopper and knife edges which engage the top and bottom edges of said sheet.

9. A sheet applicator, according to claim 1, in which the releasable sheet holder means includes vacuum cups which engage spaced locations along an edge of each, thin, flexible sheet.

10. A sheet applicator, according to claim 8, in which the releasable sheet holder means includes vacuum cups which engage the bottom sheet in said hopper at spaced locations along the bottom edge thereof between said stops and said knife edge.

11. A sheet applicator, according to claim 1, in which the releasable sheet holder means moves at least a portion of the sheet into the central opening of the shuttle when depositing the sheet on the shuttle.

12. A sheet applicator, according to claim 7, in which the releasable sheet holder means includes vacuum cups which engage a sheet in said hopper at spaced locations along an edge thereof and carry said sheet to the shuttle to deposit it on the vacuum gripper and move at least a portion of the sheet into the central opening of the shuttle with the vacuum cups releasing the sheet after it is moved into said opening.

13. A sheet applicator, according to claim 8, in which said releasable sheet holder means includes an arm mounted for rotation between said sheet hopper and said shuttle sheet transfer position, at least one vacuum cup assembly is rotatably mounted on the free end of said arm with said assembly including at lease one vacuum cup, and means to rotate said vacuum cup arm assembly relative to said sheet holder means arm during rotation of said sheet holder means arm between said sheet hopper and said shuttle sheet transfer position, said vacuum cup engaging the bottom edge of a sheet positioned in the hopper and positioning said sheet on said shuttle with said engaged edge positioned on the side of said sheet away from said hopper.

14. A sheet applicator for simultaneously applying thin, flexible sheets of paper, cellophane, plastic film or like material, individually, to each of a row of hamburger patties or like flat articles of given configuration, as the row of articles traverse a plurality of closely spaced, generally parallel, defined discharge paths with the articles in each path moving in sequentially spaced relation to the other articles in its path, the sheet applicator comprising:

a vacuum transfer shuttle, reciprocally movable along closely spaced, generally parallel shuttle paths between an application position for the sheets intersecting the row of article discharge paths and a transfer position for the sheets adjacent to but spaced from the article discharge paths, the vacuum transfer shuttle including a pair of support members extending laterally across the shuttle paths with the support members spaced apart from each other along said shuttle paths a sufficient distance to allow said articles to pass freely therebetween when the shuttle is in its application position for the sheets, the shuttle support members each including a pair of sheet support portions for each shuttle path with each sheet support portion positioned to engage a corner of a rectangular sheet positioned on the shuttle but to clear an article passing between the shuttle support members when the shuttle is in its application position for the sheets, each of said sheet support portions having a vacuum gripper thereon positioned to engage a corner of a rectangular sheet placed thereon, a sheet feeder for each shuttle path, each feeder including releasable sheet holder means for depositing a single, thin, flexible rectangular sheet on the shuttle in registry with the sheet support portions for each shuttle path whenever the shuttle reaches its sheet transfer position, each sheet being large enough to cover all of the vacuum grippers of its sheet support portions, and actuating means for actuating the shuttle and the sheet feeders in synchronization with the movement of the articles along the discharge paths and in synchronism with each other so that the sheet holder means of the sheet feeders release all of the sheets as the sheet feeders arrive at the transfer position in registry with the shuttle support portions, and so that the shuttle is in its application position for the sheets each time a row of articles move therethrough.

15. A sheet applicator, according to claim 14, in which the sheet support portions are formed as projections on the shuttle support members.

16. A sheet applicator, according to claim 15, in which the sheet support portions of adjacent shuttle paths are formed as common projections from each shuttle support member.

17. A sheet applicator for use with a reciprocal mold plate food patty molding machine in which the mold plate delivers successive rows of food patties to closely spaced, generally parallel discharge paths located outwardly of the molding machine, the sheet applicator adapted to simultaneously applied thin, flexible sheets of paper, cellophane, plastic film or like material individually to each patty in a row as the patties traverse the discharge paths, the sheet applicator comprising:

a vacuum transfer shuttle connected to the mold plate of said molding machine to move reciprocally in unison with the mold plate but in a direction opposite to that of said mold plate with the shuttle moving between an application position for the sheets intersecting the row of patty discharge paths and a transfer position for the sheets adjacent to, but spaced from the patty discharge paths, the vacuum transfer shuttle including a pair of support members extending laterally across the shuttle paths with the support members spaced apart from each other along said shuttle paths a sufficient distance to allow said patties to pass freely therebetween when the shuttle is in its sheet application position, the shuttle support members each including a pair of sheet support portions for each shuttle path with each sheet support portion positioned to engage a corner of a thin, flexible rectangular sheet positioned on the shuttle but to clear a patty passing between the shuttle support members when the shuttle is in its application position for the sheets, each of said sheet support portions having a vacuum gripper thereon positioned to engage a corner of a rectangular sheet placed thereon, a sheet feeder for each shuttle path, each feeder including releasable sheet holder means for depositing a single thin, flexible rectangular sheet on the shuttle in registry with the sheet support portions for each shuttle path whenever the shuttle reaches its sheet transfer position, each sheet being large enough to cover all of the vacuum grippers of its sheet support portions, and means for moving the shuttle and the sheet feeders in synchronism with the movement of the mold plate and in synchronism with each other so that the sheet holder means of the sheet feeders release all of the sheets as the sheet feeders arrive at the transfer position in registry with the shuttle support portions, and so that the shuttle is in its application position for the sheets each time the mold plate delivers a row of food patties to the parallel discharge paths.

18. A sheet applicator, according to claim 17, in which each of said food patties is circular in shape, each of said thin, flexible sheets has its corners extending beyond the periphery of each food patty, and each sheet support portion includes a small vacuum gripper with each gripper positioned to engage a corner of its sheet.

19. A sheet applicator, according to claim 17, in which each sheet feeder includes a sheet hopper and said sheet holder means removes a single, thin, flexible sheet from each hopper and deposits the sheet on the sheet support portions for each shuttle path whenever the shuttle reaches its sheet transfer position.

20. A sheet applicator, according to claim 19, in which a stack of thin, flexible, rectangular sheets are stored on edge on an incline formed as part of each hopper, an outlet for each hopper is located at the lower end of the incline, and the sheets are held in each hopper by stops which engage each corner of the bottom sheet of the hopper and knife edges which engage the top and bottom edges of the bottom sheet.

21. A sheet applicator according to claim 17, in which the releasable sheet holder means included vacuum cups which engage spaced locations along an edge of each thin, flexible sheet at the bottom of the hopper.

22. A sheet applicator, according to claim 17, in which the releasable sheet holder means include vacuum cups which engage a sheet of each hopper at spaced locations along an edge thereof and carry each sheet to the shuttle, deposit the sheets on the vacuum grippper and move at least a portion of each sheet into the central opening of the shuttle with the vacuum cups releasing the sheets after they are moved into said opening.

23. A vacuum shuttle for use as part of a sheet applicator for applying thin, flexible sheets of paper, cellophane, plastic film or like material, individually, to a series of hamburger patties or like flat articles of given surface configuration, as the articles traverse a given discharge path in sequential spaced relation to each other, said vacuum shuttle being reciprocally movable along a shuttle path between a sheet application position intersecting the article discharge path and a sheet transfer position adjacent to, but spaced from, the discharge path, said vacuum shuttle having a central opening which encompasses the article discharge path and through which one of the articles may pass freely when the shuttle is in its application position, said shuttle including at least three small vacuum grippers distributed around the peripheral edges of the central opening in the shuttle, just beyond the edges of an article passing therethrough, with said vacuum grippers being distributed around at least a major portion of the peripheral edges of said central opening, said sheet applicator including a sheet feeder having releasable sheet holding means for depositing a single, thin, flexible sheet on the vacuum shuttle in registry with the shuttle vacuum grippers whenever the vacuum shuttle reaches its sheet transfer position, each sheet being of a size and configuration to cover all of the shuttle vacuum grippers, and said sheet applicator including actuating means for actuating the shuttle and the sheet feeder in synchronism with the movement of the articles along the discharge path and in synchronism with each other, so that the sheet holder means of the sheet feeder releases the sheet as it arrives at the transfer position in registry with the shuttle vacuum grippers and so that the shuttle is in its sheet application position each time an article moves therethrough.

24. The vacuum shuttle, according to claim 23, in which each of said thin flexible sheets is polygonal in shape and said vacuum shuttle includes a number of small vacuum grippers equal to the number of corners of the polygonal sheet, with each vacuum gripper positioned to engage a corner of said polygonal sheet.

25. A vacuum shuttle, according to claim 23, in which each of said thin, flexible sheets is rectangular in shape and said vacuum shuttle includes four small vacuum grippers with each vacuum gripper positioned to engage a corner of said thin, flexible sheet.

26. A vacuum shuttle, according to claim 25, in which a surface of the vacuum shuttle adjacent each vacuum gripper provides support for a corner of said thin, flexible sheet.

27. A vacuum shuttle, according to claim 24, in which each of said articles is circular in shape and the corners of each thin, flexible sheet extend beyond the periphery of said circular article.

28. A vacuum shuttle, according to claim 24, in which each of said flat articles is circular in shape, each of said thin, flexible sheets is rectangular with its corners extending beyond the periphery of said circular article, and said vacuum shuttle includes four small vacuum grippers, with each gripper positioned to engage a corner of said sheet.

29. The vacuum shuttle of claim 23 in which said central opening in said shuttle is formed by a pair of support members extending laterally across the shuttle path with the support members spaced apart from each other along said shuttle path a sufficient distance to allow said articles to pass freely therebetween when the shuttle is in its application position for the sheets, the shuttle support members each including a pair of sheet support portions with each sheet support portion positioned to engage a corner of a rectangular sheet positioned on the shuttle, but to clear an article passing between the shuttle support members when the shuttle is in its application position for the sheets, each of said sheet support portions having one of said vacuum grippers thereon and positioned to engage a corner of a rectangular sheet placed thereon.

30. A vacuum shuttle, according to claim 29, in which the sheet support portions are formed as projections on the shuttle support members.

* * * * *

UNITED STATES PATENT AND TRADEMARK OFFICE

CERTIFICATE OF CORRECTION

PATENT NO. : 3,952,478

DATED : April 27, 1976

INVENTOR(S) : Louis R. Richards et al

It is certified that error appears in the above-identified patent and that said Letters Patent are hereby corrected as shown below:

In the Claims:

Claim 21, line 1, delete "17" and insert --19--.

Claim 22, line 1, delete "17" and insert --19--.

Signed and Sealed this

*Twenty-sixth* Day of *September 1978*

[SEAL]

*Attest:*

RUTH C. MASON
*Attesting Officer*

DONALD W. BANNER
*Commissioner of Patents and Trademarks*